US007578141B2

(12) United States Patent
Puthiyaveetil et al.

(10) Patent No.: US 7,578,141 B2
(45) Date of Patent: Aug. 25, 2009

(54) WATER ROUTING SYSTEM FOR REVERSIBLE DOOR REFRIGERATOR WITH DISPENSER

(75) Inventors: Sooraj Puthiyaveetil, Evansville, IN (US); Sinuhé Argumedo, Guadalupe (MX); Jeffrey Neil Wilson, Evansville, IN (US); Frank W. Klitzing, Evansville, IN (US); Matthew P. Dieg, Evansville, IN (US); Kevin R. Leatherwood, Evansville, IN (US); Jeffrey J. Smale, Newburgh, IN (US); Mark G. Steffenhagen, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 558 days.

(21) Appl. No.: 11/367,832

(22) Filed: Mar. 3, 2006

(65) Prior Publication Data

US 2007/0204647 A1 Sep. 6, 2007

(51) Int. Cl.
*B67D 5/62* (2006.01)

(52) U.S. Cl. ..... 62/389; 222/146.6; 312/326; 312/405

(58) Field of Classification Search ..... 62/389–400; 222/146.6; 312/326–329, 405
See application file for complete search history.

(56) References Cited

U.S. PATENT DOCUMENTS

| | | | | |
|---|---|---|---|---|
| 2,665,414 | A | 1/1954 | Hubacker et al. | 339/4 |
| 5,787,724 | A * | 8/1998 | Pohl et al. | 62/389 |
| 5,960,518 | A | 10/1999 | Jeong | 16/270 |
| 6,868,692 | B2 | 3/2005 | Choi | 62/389 |
| 7,281,391 | B2 * | 10/2007 | Marret et al. | 62/389 |
| 7,316,124 | B2 | 1/2008 | Lee | |

* cited by examiner

*Primary Examiner*—William E Tapolcai
(74) *Attorney, Agent, or Firm*—Kirk W. Goodwin; Greer, Burns & Crain, Ltd.

(57) ABSTRACT

A refrigerator having an in-door water dispenser and a water routing system is provided with a cabinet. A door is reversibly hinged to the cabinet at either a first edge or a second edge. A water supply line leads from a water reservoir and has a first connection at a first top front corner of the cabinet and a second connection at a second top front corner. A feeder line leads from the dispenser to a top surface of the door with an end at one of the first door edge and the second door edge. When the door is hinged along the first edge, the end of the feeder line is connected to the first connection and when the door is hinged along the second edge, the end of the feeder line is connected to the second connection.

30 Claims, 4 Drawing Sheets

WATER ROUTING SYSTEM FOR REVERSIBLE DOOR REFRIGERATOR WITH DISPENSER

BACKGROUND OF THE INVENTION

The present invention relates generally to refrigerators and in particular to refrigerators having water dispensers in the door of the refrigerator.

Refrigerators having water dispensers in the door are well known, as are arrangements for permitting the reversibility of the door swing of the refrigerator having a water dispenser in the door. For example, U.S. Pat. No. 6,868,692 discloses a refrigerator with an in-door water dispenser in which the water is supplied through a top hinge connection with the refrigerator cabinet. In the disclosed arrangement, two conduits are provided from the dispenser to the two top corners of the door, and water is selectively provided through a tube located in one or the other of the conduits, depending on the arrangement of the door hinge. There is no disclosure of how the water is supplied to the top front of the cabinet, other than a single schematic side view in FIG. 2. Two sets of redundant wiring are provided in the door, to the two top corners, for powering the water dispenser. In order to change the swing of the door, the water tube in the door must be moved from one of the conduits to the other, and a reconnection at the water dispenser must be made.

It would be an improvement in the art if a water routing system were provided for a reversible door refrigerator having a water dispenser in which the door swing may be readily reversed while allowing for easy transfer of the water supply routing and hinge from one side of the door to the other side of the door.

SUMMARY OF THE INVENTION

The present invention provides a refrigerator with an in-door water dispenser in which the door swing may be readily changed, from left to right, while allowing for easy transfer of the water supply routing and hinge from one side of the door to the other side of the door.

In an embodiment, the refrigerator comprises a cabinet enclosing a refrigeration compartment, with a water routing system including a first water supply line connection at a first top front corner of the cabinet at the first cabinet edge, a second water supply line connection at a second top front corner of the cabinet at the second cabinet edge, and a water supply line extending from a water reservoir in the cabinet to the first water supply line connection and to the second water supply line connection.

In an embodiment, the water supply line comprises a single line extending from the water reservoir to the first water supply line connection and a jumper line extending from the first water supply line connection to the second water supply line connection.

In an embodiment, the single line terminates in a first cup located in a top surface of the refrigerator cabinet adjacent to the first top front corner.

In an embodiment, the jumper line terminates at a first end in the first cup and terminates at a second end in a second cup located in a top surface of the refrigerator cabinet adjacent to the second top front corner.

In an embodiment, the water supply line comprises a first line selectively alternatively extending from the water reservoir to one of the first water supply line connection and the second water supply line connection.

In an embodiment, the refrigerator further comprises a door closing a front opening into the refrigeration compartment, the door arranged to be hinged at a first edge to the cabinet along a first edge of a front of the cabinet and alternatively at a second edge to the cabinet along a second edge of a front of the cabinet, a water dispenser mounted on the door and being accessible from an exterior of the cabinet, a feeder line leading from the dispenser to an end at a top surface of the door at one of the first door edge and the second door edge, whereby, when the door is hinged along the first door edge, the end of the feeder line is connected to the first end of the water supply line and when the door is hinged along the second door edge, the end of the feeder line is connected to the second end of the water supply line.

In an embodiment, the feeder line leads from the dispenser to an end at a top surface of the door at the first door edge, and a door jumper line leads from a first end at the top surface of the door at the first door edge to a second end at the top surface of the door at the second door edge.

In an embodiment, a first, second and third connector are provided, whereby, when the door is hinged along the first edge, the first end of the feeder line is connected to the first end of the water supply line with the first connector and when the door is hinged along the second edge, the first end of the feeder line is connected to the first end of the door jumper line with the third connector, the door jumper line second end is connected to the cabinet jumper line second end with the second connector, and the cabinet jumper line first end is connected to the first end of the water supply line with the first connector.

In an embodiment, the door jumper line terminates in a first cup located in a top surface of the refrigerator door adjacent to the first door edge.

In an embodiment, the door jumper line terminates in a second cup located in a top surface of the refrigerator door adjacent to the second door edge.

In an embodiment, the feeder line is configured with one of an L shape and a V shape.

In an embodiment, the feeder line has a V shape with one end of the V connected to the dispenser. The first end of the feeder line is at the vertex of the V shape and the second end of the feeder line is at an opposite end of the V shape from the dispenser.

In an embodiment, the feeder line has an inverted L shape and comprises a feeder conduit leading from the water dispenser to a top center of the door and through a routing conduit leading from the center to an edge of the door which includes the hinge.

In an embodiment, a top hinge for the refrigerator door includes a hollow pintle through which one of the feeder line and door jumper line extend.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
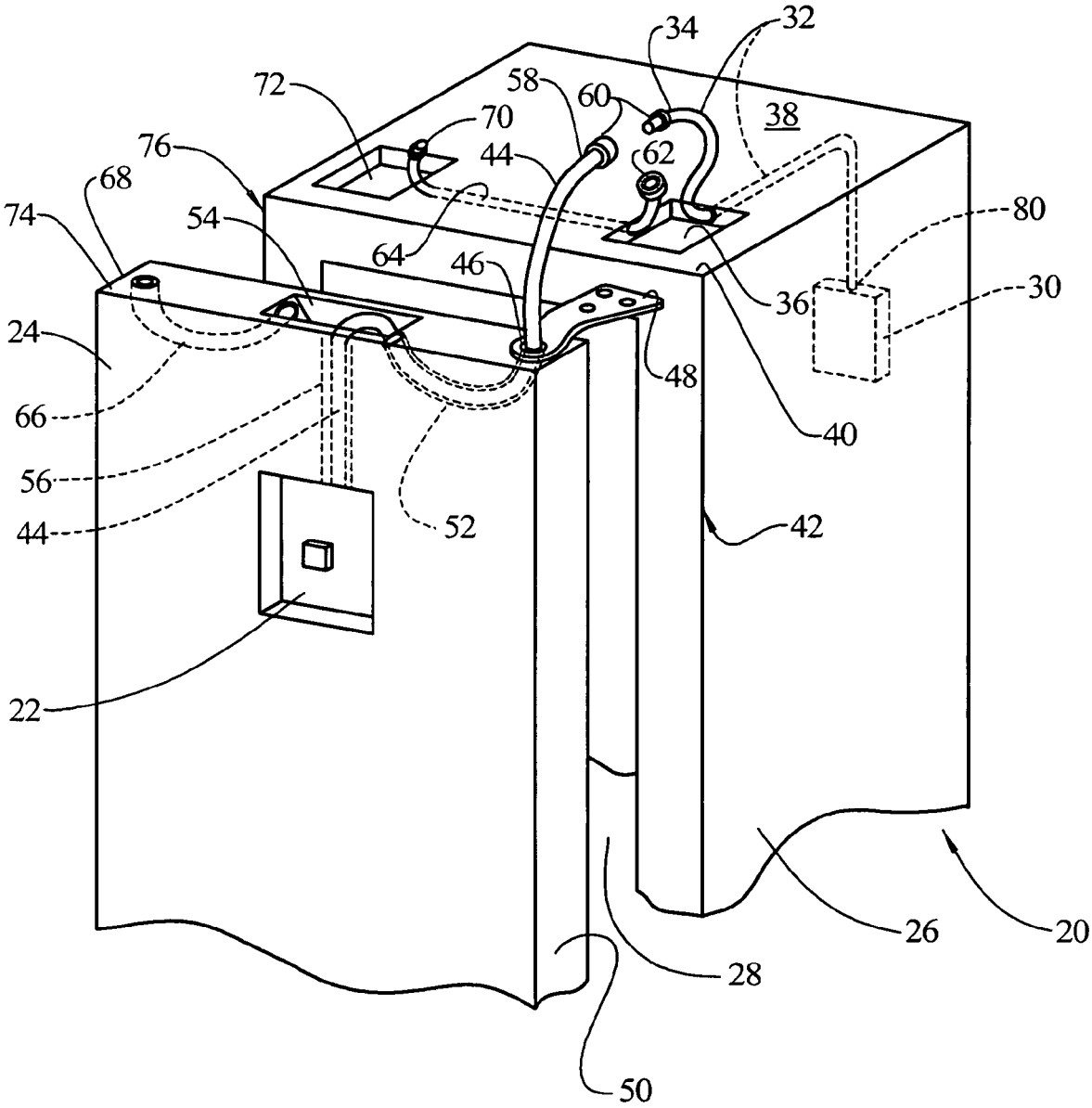
FIG. 1 is a partial perspective view of a refrigerator embodying the principles of the present invention.
Figure 2:
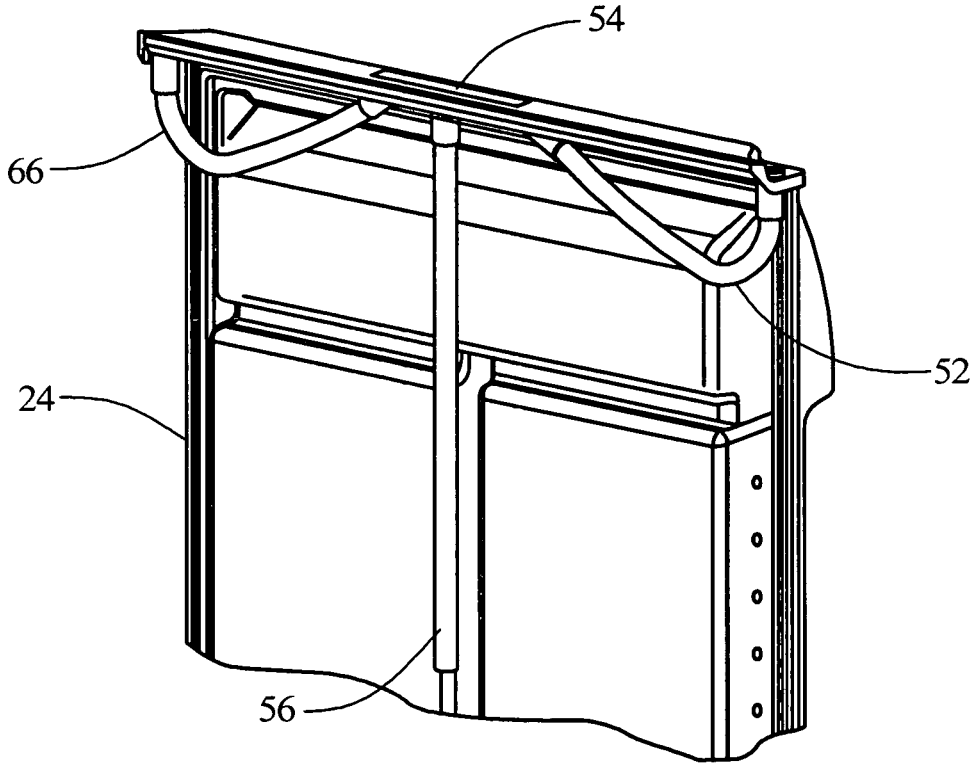
FIG. 2 is a schematic view of the interior of the door of the refrigerator with a routing conduit layout.

In an embodiment, as illustrated in FIGS. 1 and 2, the present invention provides a refrigerator 20 with an in-door water dispenser 22 in which a swing of a door 24 may be readily reversed or changed, from left to right and back, while allowing for easy transfer of a water supply routing and connection and a hinge from one side of the door to the other side of the door.

In an embodiment, the refrigerator 20 comprises a cabinet 26 enclosing a refrigeration compartment 28, with a water routing system including a water reservoir 30. The water reservoir 30 may be a container positioned in the refrigeration compartment 28 of the refrigerator 20, or may constitute a length of a water supply line 32 extending through the refrigerator, or other known arrangements for supplying water to dispensers in refrigerators. The water supply line 32 leads from the water reservoir 30 to a first end 34 in a first cup 36 located in a top surface 38 of the refrigerator cabinet 26 adjacent to a first top front corner 40 of the cabinet at a first cabinet front edge 42. The cup 36 provides a recessed space below the top surface 38. A door water feeder line 44 passes through a pintle 46 of a door hinge 48 mounted adjacent to a first edge 50 of the door 24. The door water feeder line 44 then extends through a first door routing conduit 52 to a central door cup 54, then down a second door routing conduit 56 to the in-door water dispenser 22. The door water feeder line 44, at a first end 58 thereof, is connected via a first water line connection 60, to the first end 34 of the water supply line 32.

To reverse the door 24, the first water line connection 60 is broken, and the water supply line 32 is connected to a first end 62 of a cabinet jumper water line 64. The door water feeder line 44 is pulled from the door cup 54 through the pintle 46 of the door hinge 48 and through the first door routing conduit 52, then re-routed through a third door routing conduit 66 leading to a second edge 68 of the door 24. The door water feeder line 44 is then routed through the pintle 46 of the hinge 48, which has been remounted adjacent to the second edge 68 of the door 24 and connected to a second end 70 of the cabinet jumper line 64, completing the reversal. The second end 70 of the jumper line 64 is located in a second cup 72 located in the top surface 38 of the cabinet 26 adjacent to a second top front corner 74 of the cabinet at a second cabinet front edge 76. The door water feeder line 44, when routed to either edge 50, 68 of the door, has a general L shape (inverted), leading from the dispenser 22 up to the center cup 54 at the top of the door 24, and then to one or the other edge of the door.

As illustrated in the embodiment of FIGS. 1-2, the water supply line 32 may comprise a single line extending from the water reservoir 30 to the first water supply line connection 60 and the jumper line 64 extending from the first water supply line connection to a second water supply line connection 78.

In this arrangement, the first end 34 of the single line comprises a first end of the water supply line 32, the second end 70 of the jumper line 64 comprises a second end of the water supply line, and a third end 80 of the water supply line is connected to the reservoir 30.

Figure 3:
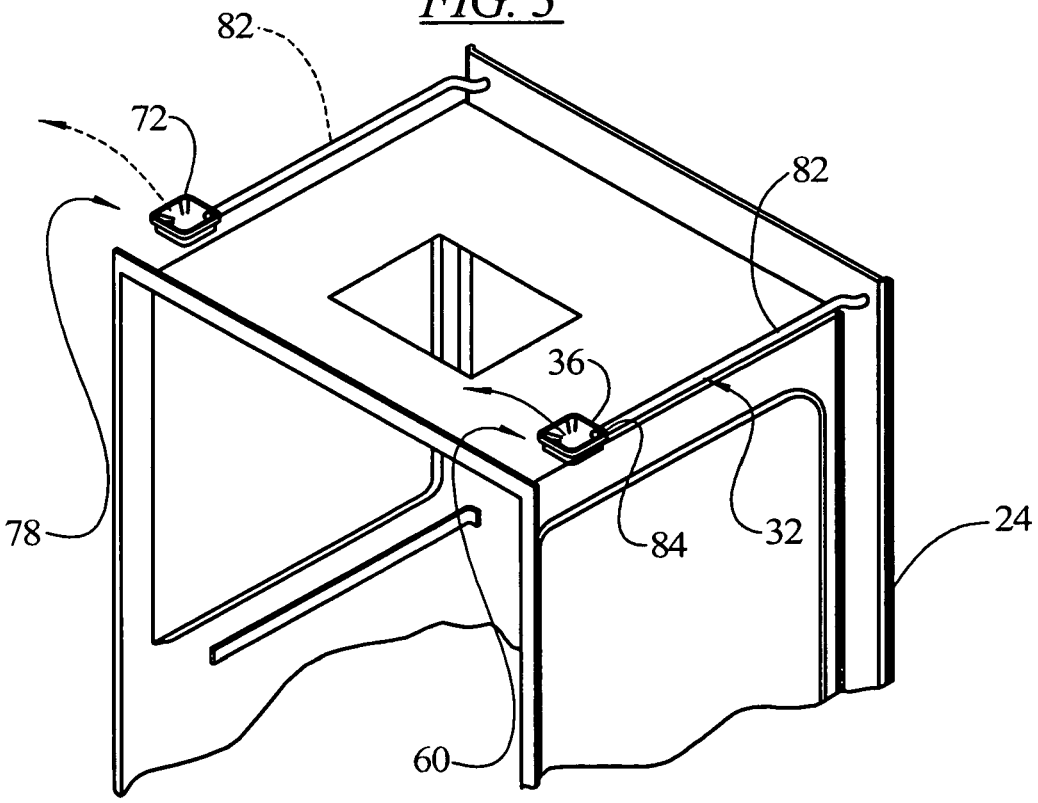
FIG. 3 is a top partial perspective view of a refrigerator with an alternate water line routing.

In another embodiment, such as illustrated in FIG. 3, the water supply line 32 comprises a first line 82 extending from the water reservoir 30 to a first end 84 at the first water supply line connection 60 in the first cup 36. If the door swing needs to be reversed, the first line 82 is disconnected at the first end 84 from the first water supply line connection 60, and then the first line 82 is withdrawn from the rear of the refrigerator cabinet 26. The first line 82 is then reinserted in to the refrigerator cabinet 26 at the other side of the refrigerator to allow the first end 84 to be connected to the second water supply line connection 78 in the second cup 72. Separate water lines leading from the reservoir 30 are not required.

Figure 4:
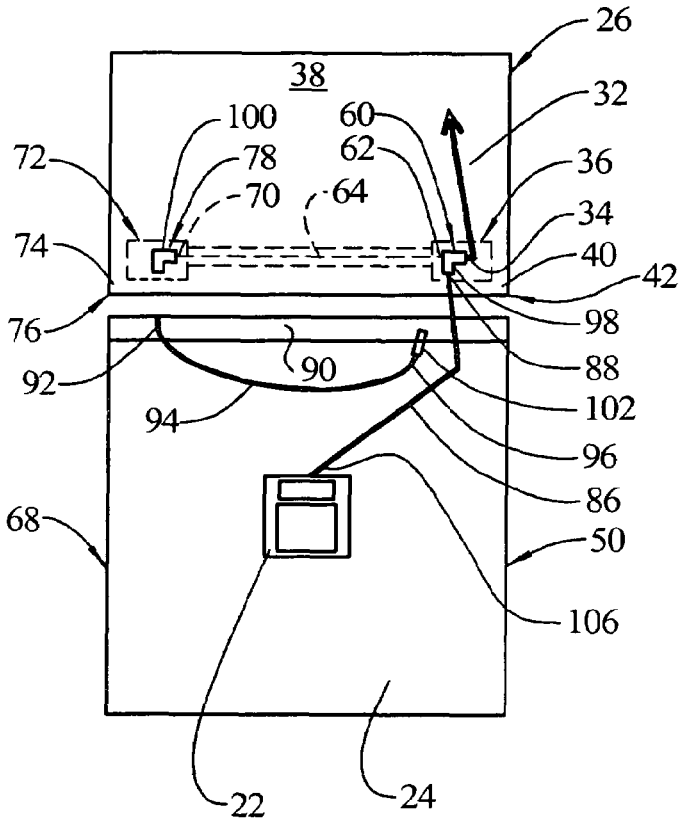
FIG. 4 is a schematic view of the refrigerator door and cabinet top showing a water line routing with a first swing of the door.
Figure 5:
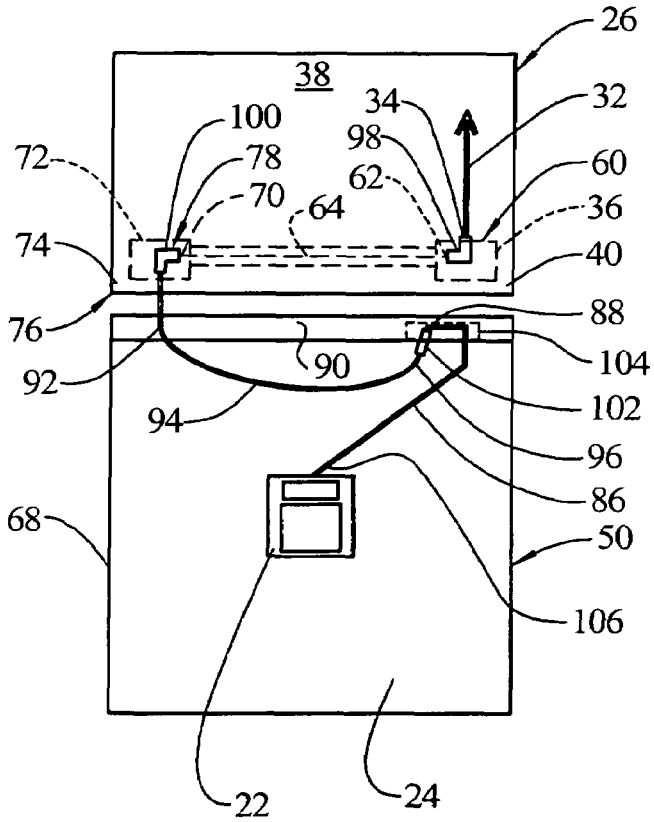
FIG. 5 is a schematic view of the refrigerator door and cabinet top showing a water line routing with an opposite swing of the door from that shown in FIG. 4.

As shown in FIGS. 4-5, the door 24 is arranged to be hinged at the first edge 50 to the cabinet 26 along the first front edge 42 of the cabinet (FIG. 4) and alternatively at a second edge 68 to the cabinet along the second front edge 76 of the cabinet (FIG. 5) depending on the desired swing for the door. The water dispenser 22 is mounted on the door 24 and is accessible from an exterior of the cabinet 26. A feeder line 86 leads from the dispenser 22 to a first end 88 at a top surface 90 of the door 24 at the first door edge 50 and to a second end 92 at the top surface of the door at the second door edge 68. When the door 24 is hinged along the first edge 50, the first end 88 of the feeder line 86 is connected to the first end 34, 84 of the water supply line 32 and when the door is hinged along the second edge 68, the second end 92 of the feeder line is connected to the second end 70 or first end 84 of the water supply line.

In an embodiment as shown in FIGS. 4-5, the feeder line 86 leads from the dispenser 22 to the first end 88 at the top surface 90 of the door 24 at the first door edge 50, and a door jumper line 94 is connected at its first end 96 to the first end 88 of the feeder line and extends to the second end 92 at the top surface of the door at the second door edge 68.

In an embodiment, a first 98, second 100 and third 102 connector are provided. These connectors 98, 100, 102 may be used to connect the various water lines together, as required, and may be of various types providing a water tight seal. A useful type of connector that applicants have located is referred to as a John Guest® connector. When the door 24 is hinged along the first edge 50 (FIG. 4), the first end 88 of the feeder line 86 is connected to the first end 34 of the water supply line 32 with the first connector 98. When the door 24 is hinged along the second edge 68 (FIG. 5), the first end 88 of the feeder line 86 is pulled back into a cup 104 located in the top surface 90 of the refrigerator door 24 adjacent to the first door edge 50. The first end 88 of the feeder line 86 is then connected to the first end 96 of the door jumper line 94 with the third connector 102, the door jumper line second end 92 is then moved to extend through the top surface 90 of the door 24 to enable the door jumper line 94 to be connected to the cabinet jumper line second end 70 with the second connector 100, and the cabinet jumper line 64 first end 62 is connected to the first end 34 of the water supply line 32 with the first connector 98.

In FIGS. 4 and 5, the feeder line 86 has a V shape with one end 106 of the V connected to the dispenser 22. The first end 88 of the feeder line 86 is at the vertex of the V shape and the second end 92 of the feeder line is at an opposite end of the V shape from the dispenser 22.

In each of the arrangements, the water supply line 32 and the feeder line 86, including jumper lines, if utilized in a particular embodiment, may be carried within sheathes, conduits or tubes such that the actual water lines, which may also be formed as tubes, are not in direct contact with the foamed-in-place insulation within the refrigerator cabinet 26 or door 24. In this way, the water lines can be moved or replaced as needed, and are not permanently secured within the refrigerator. Other lines, such as electrical wires, may also be routed through the sheathes, conduits or tubes that carry the water lines, as needed.

Figure 6:
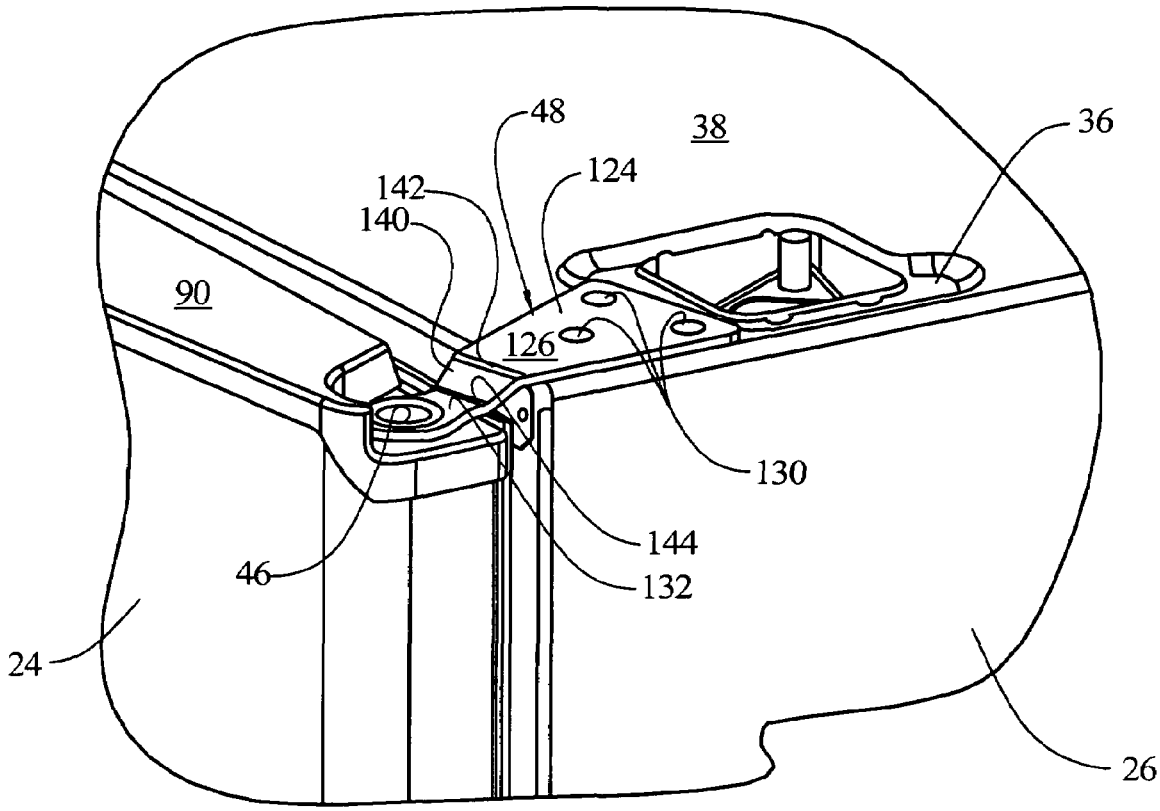
FIG. 6 is a perspective view of a hinge area at the top of the refrigerator cabinet.
Figure 7:
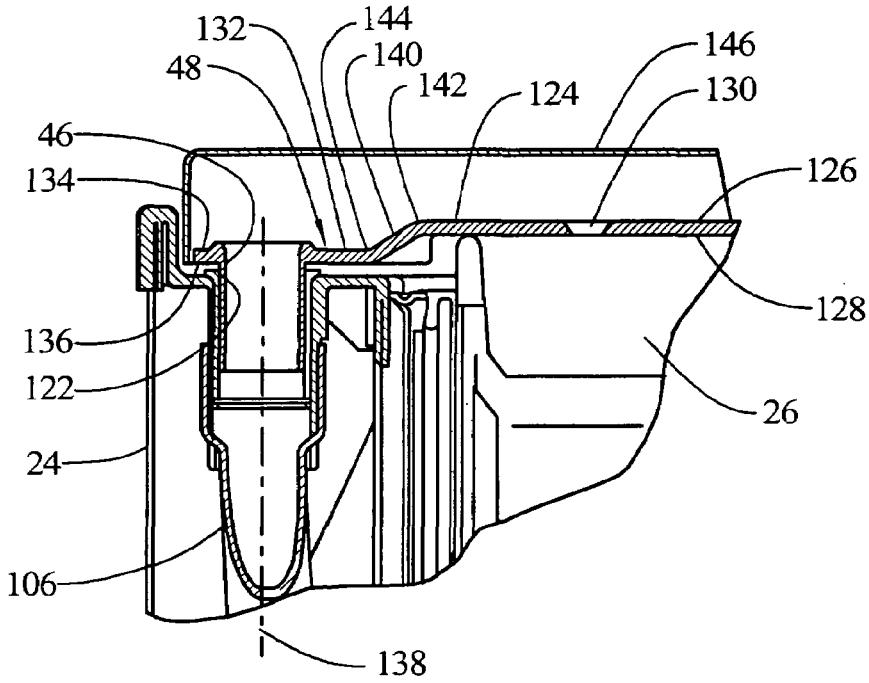
FIG. 7 is a side sectional view of the hinge area, and protective cover, generally in the region of FIG. 6.

In an embodiment as illustrated in FIGS. 6 and 7, the top hinge 48 for the refrigerator door 24 includes the hollow pintle 46 through which one of the feeder line 86 and door jumper line 94 extend and which is received in a round opening 122 in the top surface 90 of the door. The hinge 48 may comprise a first planar area 124 with an upper surface 126 and a lower surface 128, the first planar area being configured to be received on the top surface 38 of the refrigerator cabinet 26, and secured to the cabinet with threaded fasteners through holes 130 in the first planar area. The hinge 48 also includes a second planar area 132 with an upper surface 134 and a lower surface 136. The second planar area 132 is generally parallel to and positioned at a lower altitude than the first planar area 124. The second planar area 132 carries the pintle 46 extending in a first direction from the lower surface 136 such that an axis of rotation 138 through the pintle will be substantially perpendicular to the top surface 38 of the refrigerator cabinet 26. A transition section 138 connects the first planar area 124 and the second planar area 132. The transition section 138 may be a solid web between the first planar area 124 and the second planar area 132. The transition section 138 may join the first planar area 124 at a first bend 140 in the hinge 48 and the transition section may join the second planar area 132 at a second bend 142 in the hinge. The first 140 and second 142 bends may each be less than 90 degrees.

A hinge cover 144 may be used in connection with the hinge 48, to provide an aesthetic and protective covering for the water lines and electrical wires that may extend through the hinge pintle 46. With the second planar area 132 being at a lower elevation than the first planar area 124, the water line will be permitted to gradually bend and follow a natural radius between the hinge pintle 46 and the cup 36, 72, so that the cover 144 may maintain a low profile, particularly lower than with hinges that are flat or that step up from elevation and still be within the scope of our invention.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. In other embodiments, different combinations of components than those combinations specifically shown and described could be used. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A refrigerator having an in-door water dispenser and a water routing system comprising:

a cabinet enclosing a refrigeration compartment, a door closing a front opening into said refrigeration compartment, said door arranged to be hinged at a first edge to said cabinet along a first edge of a front of said cabinet or alternatively at a second edge to said cabinet along a second edge of a front of said cabinet, a water dispenser mounted on said door and being accessible from an exterior of said cabinet, a first water supply line connection at a first top front corner of said cabinet at said first cabinet edge, a second water supply line connection at a second top front corner of said cabinet at said second cabinet edge, a water supply line selectively extending from a water reservoir in said cabinet to at least one of said first water supply line connection and said second water supply line connection, a feeder line leading from said dispenser to an end at a top surface of said door at one of said first door edge and said second door edge, whereby, when said door is hinged along said first edge, said end of said feeder line is connected to said first water supply line connection and when said door is hinged along said second edge, said end of said feeder line is connected to said second water supply line connection.

2. A refrigerator according to claim 1, wherein said feeder line is configured with one of an L shape and a V shape.

3. A refrigerator according to claim 2, wherein said feeder line has a V shape with one end of said V shape connected to said dispenser, said first end of the feeder line being at a vertex of said V shape and said second end of said feeder line being at an opposite end of said V shape from said dispenser.

4. A refrigerator according to claim 2, wherein said feeder line has an L shape and comprises a conduit leading from said water dispenser to a top center of said door and through a routing conduit leading from said center to one of said edges of said door.

5. A refrigerator according to claim 1, wherein said water supply line comprises a single line leading from said reservoir to said first top front corner and a cabinet jumper line leading from said first top front corner to said second top front corner.

6. A refrigerator according to claim 1, wherein said first water supply line connection is accessible at a top surface of said cabinet.

7. A refrigerator according to claim 1, wherein a top hinge for said refrigerator door includes a hollow pintle through which said feeder line extends.

8. A refrigerator having an in-door water dispenser comprising:

a cabinet having a top wall, a bottom wall and three fixed side walls defining a refrigeration compartment and having a completely open front side providing open access to an interior of said refrigeration compartment, a door arranged to be hinged at a first edge to said cabinet along a first edge of said front open side of said cabinet or alternatively at a second edge to said cabinet along a second edge of said front open side of said cabinet, said door being a movable element separate from said cabinet but being attached to said cabinet and movable to selectively open and close said open front side of said cabinet, a first water supply line connection at a first top front corner of said cabinet at said first cabinet edge, a second water supply line connection at a second top front corner of said cabinet at said second cabinet edge, and a water supply line selectively extending from a water reservoir in said cabinet to at least one of said first water supply line connection and said second water supply line connection.

9. A refrigerator having an in-door water dispenser comprising:

a cabinet enclosing a refrigeration compartment and having a front opening, a door closing the front opening, said door arranged to be hinged at a first edge to said cabinet along a first edge of a front of said cabinet or alternatively at a second edge to said cabinet along a second edge of a front of said cabinet, a first water supply line connection at a first top front corner of said cabinet at said first cabinet edge, a second water supply line connection at a second top front corner of said cabinet at said second cabinet edge, and a water supply line selectively extending from a water reservoir in said cabinet to at least one of said first water supply line connection and said second water supply line connection, wherein said water supply line comprises a single line extending from said water reservoir to said first water supply line connection and a jumper line extending from said first water supply line connection to said second water supply line connection.

10. A refrigerator according to claim 9, wherein said single line terminates in a first cup located in a top surface of said refrigerator cabinet adjacent to said first top front corner.

11. A refrigerator according to claim 10, wherein said jumper line terminates at a first end in said first cup and terminates at a second end in a second cup located in a top surface of said refrigerator cabinet adjacent to said second top front corner.

12. A refrigerator according to claim 8, wherein said water supply line comprises a first line selectively alternatively extending from said water reservoir to one of said first water supply line connection and said second water supply line connection.

13. A refrigerator having an in-door water dispenser and a water routing system comprising:

a cabinet enclosing a refrigeration compartment, a door closing a front opening into said refrigeration compartment, said door arranged to be hinged at a first edge to said cabinet along a first edge of a front of said cabinet and alternatively at a second edge to said cabinet along a second edge of a front of said cabinet, a water dispenser mounted on said door and being accessible from an exterior of said cabinet, a water supply line leading from a reservoir in said cabinet to an end adjacent to a first top front corner of said cabinet at said first cabinet edge, a cabinet jumper line having a first end adjacent to said first top front corner of said cabinet and a second end adjacent to a second top front corner of said cabinet at said second cabinet edge, a feeder line leading from said dispenser to an end at a top surface of said door at said first door edge, a door jumper line leading from a first end at said top surface of said door at said first door edge to a second end at said top surface of said door at said second door edge, and a first, second and third connector, whereby, when said door is hinged along said first edge, said end of said feeder line is connected to said end of said water supply line with said first connector and when said door is hinged along said second edge, said feeder line is connected to said first end of said door jumper line with said third connector, said door jumper line second end is connected to said cabinet jumper line second end with said second connector, and said cabinet jumper line first end is connected to said end of said water supply line with said first connector.

14. A refrigerator according to claim 13, wherein said water supply line terminates in a first cup located in a top surface of said refrigerator cabinet adjacent to said first top front corner.

15. A refrigerator according to claim 14, wherein said cabinet jumper line terminates at said first end in said first cup.

16. A refrigerator according to claim 15, wherein said cabinet jumper line terminates at said second end in a second cup located in said top surface of said refrigerator cabinet adjacent to said second top front corner.

17. A refrigerator according to claim 13, wherein said door jumper line terminates in a first cup located in a top surface of said refrigerator door adjacent to said first door edge.

18. A refrigerator according to claim 17, wherein said door jumper line terminates in a second cup located in a top surface of said refrigerator door adjacent to said second door edge.

19. A refrigerator according to claim 13, wherein a top hinge for said refrigerator door includes a hollow pintle through which one of said feeder line and door jumper line extend.

20. A refrigerator according to claim 19, wherein said hinge comprises a first area configured to be received on a top surface of said refrigerator cabinet, a second area, substantially parallel to and positioned at a lower altitude than said first area, said second area carrying said pintle such that an axis of rotation through said pintle is substantially perpendicular to a surface of said second area, and a transition section connecting said first area and said second area.

21. A refrigerator having an in-door water dispenser and a water routing system comprising:

a cabinet enclosing a refrigeration compartment, a door closing a front opening into said refrigeration compartment, said door arranged to be hinged at a first edge to said cabinet along a first edge of a front of said cabinet, said door having a top surface with an area recessed below said top surface at said first edge, a water dispenser mounted on said door and being accessible from an exterior of said cabinet, a water supply line leading from a reservoir in said cabinet to an end adjacent to a first top front corner of said cabinet at said first cabinet edge, a feeder line leading from said dispenser to an end adjacent a top surface of said door at said first door edge, a top hinge for said refrigerator door including a hollow pintle through which said feeder line extends, said hinge comprising a first area configured to be received on a top surface of said refrigerator cabinet, a second area, substantially parallel to and positioned at a lower altitude than said first area, configured to be received at said recessed area of said top surface of said door, said second area carrying said pintle such that an axis of rotation through said pintle is substantially perpendicular to a surface of said second area, and a transition section connecting said first area and said second area.

22. A refrigerator according to claim 21, wherein said transition section is a solid web extending between said first area and said second area.

23. A refrigerator according to claim 21, wherein said transition section joins said first area at a first bend in said hinge and said transition section joins said second area at a second bend in said hinge.

24. A refrigerator according to claim 23, wherein said first and second bends are each less than 90 degrees.

25. A refrigerator according to claim 21, wherein said first and second areas are substantially planar.

26. A refrigerator door and top hinge system for attaching to a refrigeration cabinet, comprising:

a refrigerator door having an in-door water dispenser supplied with water from a water conduit and having a top surface with an area recessed below said top surface at an edge of said door;

a top hinge for the refrigerator door;

the top hinge having a first area configured to be received on a top surface of said refrigerator cabinet;

a hollow pintle through which said water conduit extends;

a second area, substantially parallel to and positioned at a lower altitude than said first area, configured to be received at said recessed area of said top surface of said door, said second area carrying said pintle such that an axis of rotation through said pintle is substantially perpendicular to a surface of said second area; and a transition section connecting said first area and said second area.

27. A refrigerator according to claim 26 wherein said transitional section is a solid web extending between said first area and said second area.

28. A refrigerator according to claim 26, wherein said transitional section joins said first area at a first bend in said hinge and said transitional section joins said second area at a second bend in said hinge.

29. A refrigerator according to claim 26, wherein said first and second bends are each less than 90 degrees.

30. A refrigerator according to claim 26, wherein said first and second areas are substantially planar.

* * * * *

UNITED STATES PATENT AND TRADEMARK OFFICE

CERTIFICATE OF CORRECTION

PATENT NO. : 7,578,141 B2
APPLICATION NO. : 11/367832
DATED : August 25, 2009
INVENTOR(S) : Puthiyaveetil et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 733 days.

Signed and Sealed this

Seventh Day of September, 2010

David J. Kappos

David J. Kappos
*Director of the United States Patent and Trademark Office*